US007437090B2

(12) United States Patent
Soya

(10) Patent No.: US 7,437,090 B2
(45) Date of Patent: Oct. 14, 2008

(54) IMAGE HEATING APPARATUS WITH CONTROL MEANS FOR EFFECTING CONTROL OF POWER SUPPLY

(75) Inventor: Takashi Soya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 11/470,806

(22) Filed: Sep. 7, 2006

(65) Prior Publication Data

US 2007/0098426 A1 May 3, 2007

(30) Foreign Application Priority Data

Sep. 13, 2005 (JP) ..... 2005-265877

(51) Int. Cl.
*G03G 15/20* (2006.01)

(52) U.S. Cl. ..... 399/67; 399/69

(58) Field of Classification Search ..... 399/67, 399/329, 69, 70

See application file for complete search history.

(56) References Cited

U.S. PATENT DOCUMENTS 6,134,400 A * 10/2000 Higashi et al. ..... 399/70
6,308,022 B1 * 10/2001 Sasai ..... 399/70
6,807,386 B2 * 10/2004 Yasui et al. ..... 399/69
2005/0095026 A1 * 5/2005 Ota ..... 399/70

FOREIGN PATENT DOCUMENTS

| | | |
|---|---|---|
| JP | 2002-196613 | 7/2002 |
| JP | 2003-271002 | 9/2003 |
| JP | 2004-117518 | 4/2004 |

* cited by examiner

*Primary Examiner*—Quana M Grainger
(74) *Attorney, Agent, or Firm*—Fitzpatrick, Cella, Harper & Scinto

(57) ABSTRACT

An image heating apparatus capable of compatibly realizing enhancement of durability of a heat rotation member heated by magnetic flux from magnetic flux generation means and early rise up of the image heating apparatus to a heatable temperature includes magnetic flux generation means, heating means, drive means, pressure rotation member, and control means. The control means controls power supply to the magnetic flux generation means and the heating means and rotational drive of the drive means. The control means effects control so that rotational drive of the heat rotation member and the pressure rotation member and power supply to the magnetic flux generation means are stopped until a temperature of the pressure rotation member reaches a predetermined value after power supply to the heating means is effected at the time of startup of the image heating apparatus.

8 Claims, 4 Drawing Sheets

IMAGE HEATING APPARATUS WITH CONTROL MEANS FOR EFFECTING CONTROL OF POWER SUPPLY

FIELD OF THE INVENTION AND RELATED ART

The present invention relates to an image heating apparatus for heating an image on a recording material by nipping and conveying the recording material through a nip formed between a heat rotation member generating heat by electromagnetic induction heating and a pressure rotation member heated by heating means such as a halogen heater.

An image forming apparatus of an electrophotographic process type such as a copying machine or a printer includes an image forming portion and an image heat-fixing apparatus (hereinafter referred to as a "fixing apparatus") for heat-fixing a toner image formed on a recording material (hereinafter referred to as a "transfer material") at the image forming portion.

As the fixing apparatus, e.g., one of a hot roller fixation type wherein the toner image is melted and fixed on the transfer material by applying heat and pressure to the toner image while nipping and conveying a nip (nip portion) between a fixation roller and a pressure roller which are rotated and pressed against each other has been known.

In the fixing apparatus, in recent years, a high process speed is required in order to realize high-speed output of an image forming apparatus. For this reason, a larger nip width (width of nip) tends to be needed. Japanese Laid-Open Patent Application (JP-A) 2004-117518 has proposed a belt fixing method in which a fixing roller and/or a pressure roller is replaced by an endless belt to ensure a wide nip. According to this method, compared with a hot roller fixing method having the same size, it has such an advantage that a considerably large nip can be ensured.

Further, as a fixing apparatus, those of an induction heating type wherein eddy currents are generated in an electroconductive layer provided in a fixation roller or an endless belt by a magnetic field from an exciting coil to generate heat by Joule heating have been proposed by, e.g., JP-A 2002-196613 or JP-A 2003-271002. The apparatus of this type is characterized by a high thermal efficiency because of a short and simple heat transmission path from a heat generation source to a toner image.

In the case where an induction heating-type fixing apparatus which causes an induction heat generation member to partially generate heat in a rotation direction of the heat generation member, it is necessary to rotationally drive a belt during the heating. This is because a temperature irregularity occurs in a circumferential direction of the belt when the belt is heated while being stopped. However, the belt to be induction-heated contains an electroconductive layer as a metallic layer, so that a total rotation time (rotation number) of the belt has a limit in terms of durability. For this reason, when the belt is excessively rotated continuously, the total rotation time reaches the limited time early.

Further, a pressure rotation member for forming a nip with the fixing belt contacts the fixing belt, so that the pressure rotation member is required to be heated to some extent in order to ensure fixability. In view of this requirement, such a constitution that heating means for heating the pressure rotation member for reducing a warm-up time is separately provided to heat both of the fixing belt and the pressure rotation member has been proposed.

In this case, it is possible to consider that heating start timings of the pressure rotation member and the belt are matched in order to reduce the warm-up time. However, the pressure rotation member generally have a heat capacity larger than that of the belt, so that a time required for heating the pressure rotation member is longer than that required for heating the fixing belt. For this reason, the same timing of heating start of the pressure rotation member and the fixing belt is accompanied with such a problem that the rotation of the belt exceeds rotation necessary to obviate the temperature irregularity of the belt, thus shortening life of the belt.

SUMMARY OF THE INVENTION

An object of the present invention is to provide an image heating apparatus which partially heats a belt through induction heating and includes heating means for separately heating a pressure rotation member forming a nip with the belt, wherein a temperature irregularity in a circumferential direction of the belt is capable of being prevented while minimizing shortening of life of the belt by rotation of the belt during warm-up to reduce a warm-up time.

An image heating apparatus according to an aspect of the present invention principally includes magnetic flux generation means, a heat rotation member generating heat by magnetic flux from the magnetic flux generation means, a pressure rotation member contactable with the heat rotation member to form a nip therebetween, heating means for heating the pressure rotation member, drive means for rotationally driving the heat rotation member and the pressure rotation member, and control means for controlling power supply to the magnetic flux generation means and the heating means and rotational drive of the drive means. In the image heating apparatus, an image on a recording material is heated by nipping and conveying the recording material through the nip.

The control means effects control so that rotational drive of the heat rotation member and the pressure rotation member and power supply to the magnetic flux generation means are stopped until a temperature of the pressure rotation member reaches a predetermined value after power supply to the heating means is effected at the time of startup of the image heating apparatus.

According to the image heating apparatus of the present invention, it is possible to compatibly realize enhancement of durability of the heat rotation member heated by magnetic flux from the magnetic flux generation means and early rise up of the image heating apparatus to a heatable temperature.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described with reference to the drawings.

Embodiment 1

Figure 1:
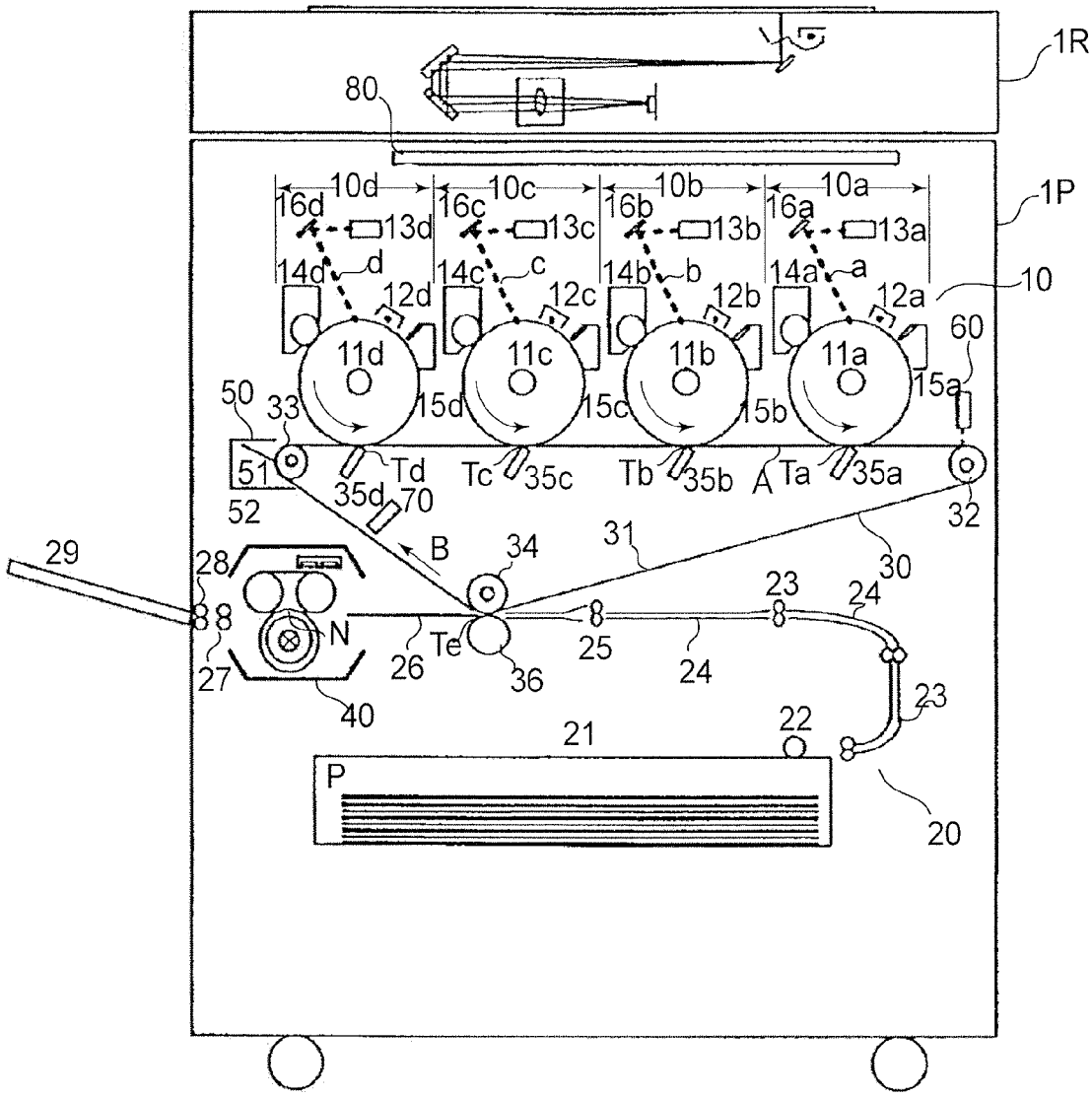
FIG. 1 is a schematic view showing an example of a general structure of an image forming apparatus according to the present invention.

FIG. 1 is a general structural view showing an example of an image forming apparatus to which an image heating apparatus according to the present invention is mountable as an image heat-fixing apparatus.

The image forming apparatus shown in FIG. 1 is an electrophotographic color copying machine which includes a plurality of image forming units disposed in tandem arrangement (with parallel rotation axes of photosensitive members) and employs an intermediary transfer method. The image forming apparatus includes an image reading portion 1R and an image output portion 1P. The image reading portion 1R optically reads an original image and converts the read data into an electrical signal to be transmitted to the image output portion 1P. The image output portion 1P includes four image forming portions 10 (10*a*, 10*b*, 10*c* and 10*d*), a paper (sheet) feeding unit 20, an intermediary transfer unit 30, a fixing unit 40 as the image heat-fixing apparatus, a cleaning unit 50, a cleaning blade 70, a photosensor 60, and a control unit 80 as control means.

The image forming portion 10*a* to 10*d* have the same constitution. At each of the image forming portions 10*a* to 10*d*, a drum-like electrophotographic photosensitive member 11*a*, 11*b*, 11*c* or 11*d* as a first image bearing member (hereinafter referred to as a "photosensitive drum") is rotatably supported by a shaft (axis) and rotated in a direction of an indicated arrow. Around each of the photosensitive drums 11*a* to 11*d*, members including a primary charger 12*a*-12*d*, an optical system 13*a*-13*d*, a folding mirror 16*a*-16*d*, a developing apparatus 14*a*-14*d*, and a cleaning apparatus 15*a*-15*d* are disposed opposite to the associated photosensitive drum 11*a*-11*d* in this order in the rotation direction of the associated photosensitive drum.

At the surface of each photosensitive drum (11*a*-11*d*), a uniform amount of electric charge is provided by the primary charger (12*a*-12*d*). Then, each photosensitive drum (11*a*-11*d*) is subjected to exposure to light (a-b), such as laser beam, modulated depending on a recording image read signal from the image reading portion 1R through the folding mirror (16*a*-16*d*) by means of the optical system (13*a*-13*d*). As a result, on the surface of the photosensitive drum (11*a*-11*d*), an electrostatic latent image is formed. The electrostatic latent image is developed as a visible (toner) image by each of the developing apparatuses 14*a*-14*d* containing developers of four colors of yellow, cyan, magenta, and black (hereinafter, referred to as "toner(s)". The visible image is transferred, in a primary transfer area (Ta-Td), onto a belt-like intermediary transfer member, i.e., an intermediary transfer belt 31, as a second image bearing member constituting an intermediary transfer unit 30 described later in detail.

At a portion downstream from the respective image transfer areas Ta-Td, toners remaining on the photosensitive drums 11*a*-11*d* without being transferred onto the intermediary transfer belt 31 are removed by the cleaning apparatuses 15*a*-15*d*, respectively, to effect cleaning of the respective drum surfaces.

As described above, image formation with each other is successively effected.

The feeding unit 20 includes a cassette 21 for accommodating a transfer material P as a recording material and a pickup roller 22 for feeding the transfer material P one by one from the cassette 21. The feeding unit 20 further includes a pair of feeding rollers 23 for feeding and conveying the transfer material P fed from the pickup roller 22, a feed guide 24, and registration rollers 25 for feeding the transfer material P to a secondary transfer area Te at image forming timings of the respective image forming.

The intermediary transfer unit 30 will be described more specifically. The intermediary transfer belt 31 is stretched and extended around a drive roller 32 for driving the intermediary transfer belt 31, a follower roller 33 for applying, an appropriate tension to the intermediary transfer belt 31 by biasing action of a spring (not shown), and an opposite roller 34 for secondary transfer, in an appropriate tension state. Further, between the drive roller 32 and the follower roller 33, a primary transfer plane A is created. The intermediary transfer belt 31 may be formed of polyethylene terephthalate (PET), polyvinylidene fluoride (PVdF), etc. The drive roller 32 is prepared by coating a surface of a metal roller with a layer of rubber (such as urethane rubber or chloroprene rubber) in a thickness of several millimeters, thus preventing slippage with respect to the intermediary transfer belt. The drive roller 32 is rotationally driven by a pulse motor (not shown). In the primary transfer areas Ta-Td where the respective photosensitive drums 11*a*-11*d* and the intermediary transfer belt 31, primary transfer chargers 35*a*-35*d* are disposed at a back side of the intermediary transfer belt 31. Further, a secondary transfer roller 36 is disposed opposite to the secondary transfer opposite roller 34 so that if forms a nip with the intermediary transfer belt 31 in the secondary transfer area Te. The secondary transfer roller 36 is pressed against the intermediary transfer belt 31 at an appropriate pressure.

At a portion downstream from the secondary transfer area Te of the intermediary transfer belt 31, the cleaning unit 50 for cleaning the image forming surface of the intermediary transfer belt 31 is disposed. The cleaning unit 50 includes a cleaning blade 51 for removing toner on the intermediary transfer belt 31 and a waste toner box 52 for accommodating waste toner.

Further, between the secondary transfer area Te of the intermediary transfer belt 31 and the cleaning unit 50, a cleaning blade 70 and a pulse motor (not shown) capable of permitting contact of the cleaning blade 70 with the intermediary transfer belt 31 and removal of the cleaning blade 70 from the intermediary transfer belt 31. The cleaning blade 70 is also used to remove the toner remaining on the intermediary transfer belt 31.

The intermediary transfer unit 30 further includes a guide 26 for guiding the transfer material P into a nip N in the fixing unit 40, an inner discharge roller 27 and an outer discharge roller which are used for discharging (outputting) the transfer material P from the fixing unit 40 to the outside of the image forming apparatus, and a discharge tray 29 for mounting thereon the discharged (outputted) transfer material P.

Next, an operation of the above mentioned image forming apparatus (color copying machine) will be described.

The control unit 80 (not shown in FIG. 1) includes a CPU for controlling operations of mechanisms in the above described respective units, a registration correction circuit, and a motor driver portion. When an image forming operation start signal is given by the CPU, a sheet feeding operation of the transfer material P from a sheet feeding stage selected on the basis of selected sheet size is started.

For example, the case where the transfer material P is fed from an upper sheet feeding stage will be described. Referring to FIG. 1, first, the transfer material P is fed from the cassette 21 one by one. The transfer material P is guided and conveyed to the registration rollers 25 through the feeding guide 24 by the pair of feeding rollers 23. At that time, the registration rollers 25 are stopped, so that a leading end of the transfer material P reaches the nip. Thereafter, rotation of the registration rollers 25 is started in synchronism with timings of start of image formation at the image forming portions 10*a*-10*d*. These timings are set so that the transfer material P and the toner image which has been primary-transferred onto the intermediary transfer belt 31 at the image forming portions are conveyed simultaneously in the nip to permit secondary transfer of the toner image onto the transfer material P.

On the other hand, at the image forming portions 10*a*-10*d*, when the image forming operation start signal is provided, the toner image formed on the photosensitive drum lid located on the extreme upstream side is primary-transferred. More specifically, by applying a high voltage to the primary transfer charger 35*d*, the toner image on the photosensitive drum lid is primary-transferred onto the intermediary transfer belt 31 in the primary transfer area Td. The transferred toner image is conveyed to a subsequent primary transfer area Tc in which image formation is effected at timing such that the image formation is started after a lapse of time requiring conveyance of the toner image between the first and second image forming portions 10*d* and 10*c*. In the primary transfer area Tc, the toner image is primary-transferred onto the previous toner image in a superposition manner. The similar steps are repeated with respect to the remaining image forming portions 10*b* and 10*a*. Consequently, four color toner images are primary-transferred onto the intermediary transfer belt 31.

Thereafter, when the transfer material P enters the secondary transfer area Te and contacts the intermediary transfer belt 31, the high voltage is applied to the secondary transfer roller 36 at the timing of passing of the transfer material P. As a result, the four-color toner image formed on the intermediary transfer belt 31 by the above described process is transferred onto the transfer material P. Then, the transfer material P is accurately guided in the nip N of the fixing unit 40 by the conveyance guide 26.

In the fixing unit 40, the transfer material P is nipped and conveyed in the nip. During the conveyance of the transfer material P, the toner image is fixed on the surface of the transfer material P by heat and pressure.

The transfer material P, after being passed through the nip N, is conveyed by the inner and outer discharge rollers 27 and 28 to be mounted on the discharge tray 29.

<Constitution of Fixing Unit 40>

Figure 2:
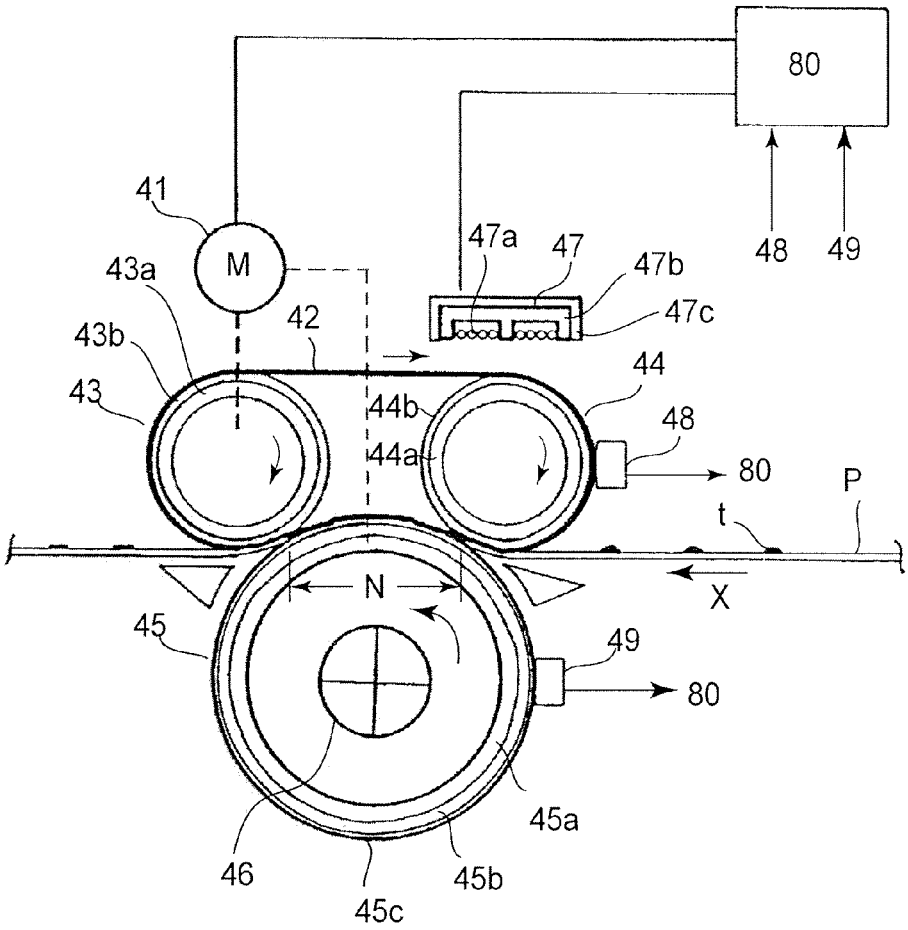
FIG. 2 is a schematic cross-sectional view of a fixing unit used in Embodiment 1 of the present invention.

FIG. 2 is a cross-sectional side view of the fixing unit 40.

The fixing unit 40 includes a flexible endless fixing belt 42 as the heat rotation member (hereinafter, simply referred to as a "belt"). The belt 42 is stretched between a drive roller 43 and a follower roller 44 in a tension state. A pressure roller 45 as the pressure rotation member is pressed against the drive roller 43 and the follower roller 44 through the belt 42 by a pressure spring or the like (not shown). As a result, the pressure roller 45 is pressed against the belt 42 to form the nip (fixation nip) N therebetween. The drive roller 43 and the pressure roller 45 are connected with a motor 41 as drive means. In the neighborhood of the follower roller 44, a coil unit 47 as magnetic flux generation means is disposed opposite to the belt 42. Inside the pressure roller 45, a halogen lamp heater 46 as heating means (hereinafter, simply referred to as a "heater") is disposed. A temperature sensor 48 as temperature detection means is disposed, opposite to the follower roller 44, in contact with an outer peripheral surface of the belt 42. A transfer sensor 49 is disposed in contact with an outer peripheral surface of the pressure roller 45.

The above described members including the drive roller 43, the follower roller 44, the pressure roller 45, the coil unit 47, and the heater 46 are elongated members extending in a width direction perpendicular to a conveyance direction X of the transfer material P. The drive roller 43, the follower roller 44, and the pressure roller 45 are rotatably supported through bearings by a pair of unit side plates at respective end portions of the rollers. Further the coil unit 47 and the heater 46 is fixedly supported by the unit side plates at respective end portions of these members. The temperature sensors 48 and 49 are supported by the unit side plates by respective sensor supporting members (not shown).

Figure 3:
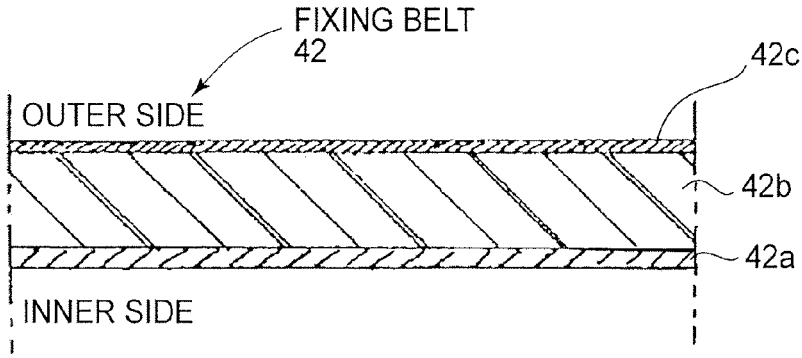
FIG. 3 is a schematic sectional view showing an example of a layer structure of a fixing belt.

FIG. 3 is a sectional view showing an example of a layer structure of the belt 42. The belt 42 includes a sleeve-like support 42*a*, formed of Ni, located on an inner side (close to the drive roller 43 and the follower roller 44). On the other peripheral surface of the support 42*a*, a silicone rubber layer 42*b* as an elastic layer is disposed and thereon, a fluorine-containing resin layer 42*c* as a release layer is disposed.

The drive roller 43 and the follower roller 44 have the same constitution. More specifically, these rollers include supports 43*a* and 44*a* of iron-made sleeve, silicone rubber sponge layers 43*b* and 44*b* as an elastic layer located on the outer peripheral surfaces of the supports 43*a* and 44*a*, and surface layers 43*c* and 44*c* of PFA tubes as a release layer.

The pressure roller 45 includes a support 45*a* of an aluminum-made sleeve, a silicone rubber layer 45*b* as an elastic layer located on the outer peripheral surface of the support 45*a*, and a surface layer 45*c* of PFA tube as a release layer.

The coil unit 47 includes an exciting coil 47*a*, a magnetic core 47*b*, and a coil holder 47*c*. The core 47*b* is formed in a substantially E-(character) shape in cross-section. The coil 47*a* is formed of litz wire which is supported by and wound about the core 47*b* in elliptical end flattened shape. The resultant core 47*b* is supported by the holder 47*c* and then is supported by the unit side plates at both end portions of the holder 47*c*.

<Startup Operation of Fixing Unit 40>

When an image forming operation start signal is provided, the fixing unit 40 is actuated in accordance with a temperature control sequence stored in the control unit 80.

Figure 4:
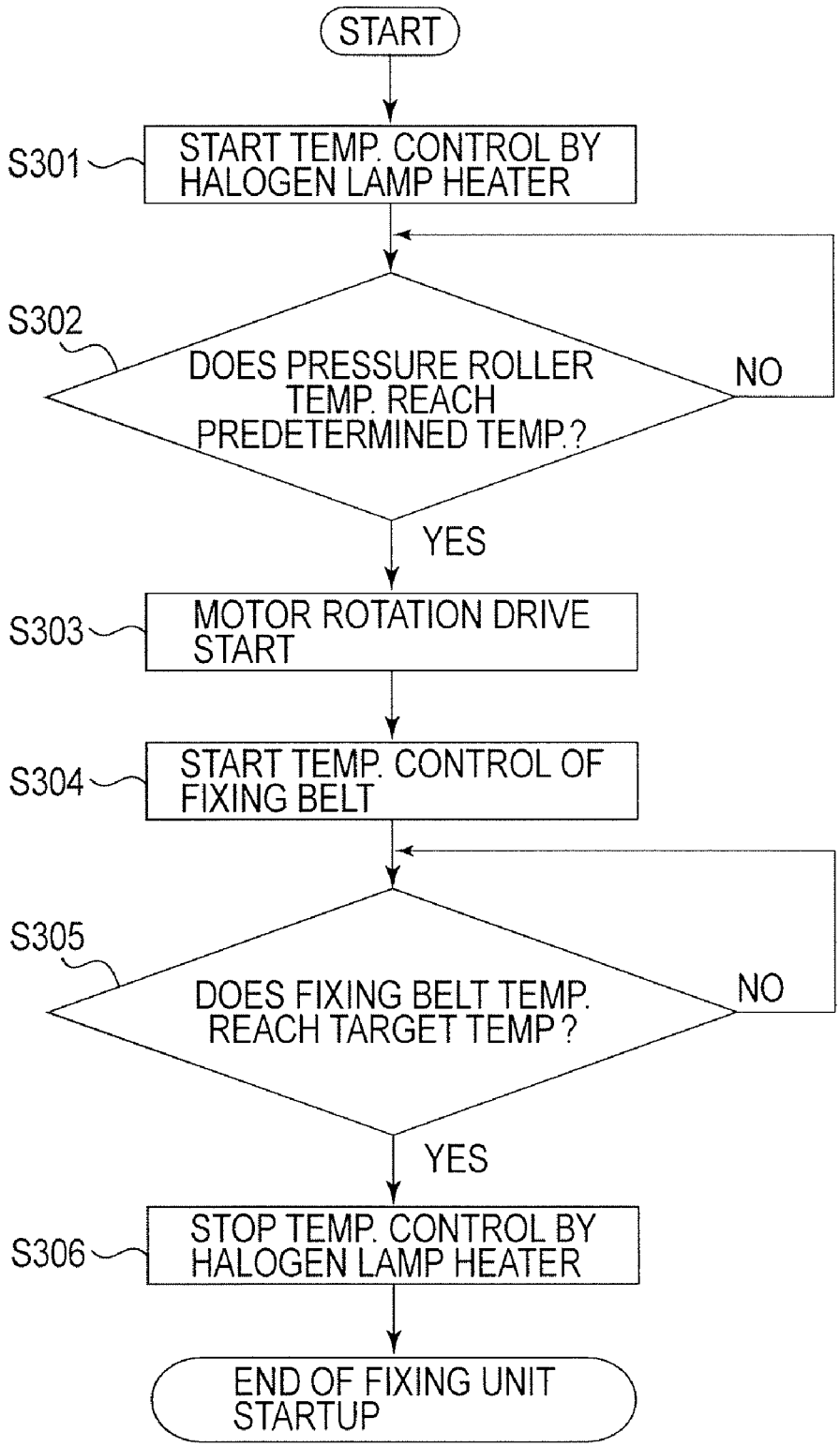
FIG. 4 is a control flow chart showing an example of control procedure during startup of the fixing unit.

FIG. 4 is an example of a control flow chart of the fixing unit 40 during startup thereof.

First, the control unit 80 turns the heater 46 on to start temperature control of the pressure roller 45 while stopping the motor 41, i.e., while stopping the fixing belt 42 without driving the drive roller 43 and the pressure roller 45 (S301). More specifically, the control unit 80 turns the heater 46 on until a temperature of the pressure roller 45 reaches a target (predetermined) temperature (150° C. in this embodiment). After the temperature of the pressure roller 45 reaches 150° C., the control unit 80 turns on and off so that the temperature of the pressure roller 45 is approximately 150° C.

Next, the control unit 80 determines whether or not the temperature of the pressure roller 45 detected by the temperature sensor 49 has reached the target temperature. When the temperature is below the target temperature, the heater 46 is still turned on continuously. When the temperature reaches the target temperature, the operation goes to a next step (S302).

The control unit 80 starts rotational drive of the pressure roller 45 after the pressure roller 45 reaches the target temperature (S303). Here, the motor 41 is rotationally driven in an arrow direction (FIG. 3) through an unshown gear. A rotational force of the drive roller 43 is transmitted to the belt 42, whereby the belt 42 is also rotationally moved. A force of the rotational movement of the belt 42 is transmitted to the follower roller 44, whereby the follower roller 44 is rotated by the rotational movement of the belt 42. Further, the pressure roller 45 is also rotationally driven in an arrow direction (FIG. 3) through an unshown gear.

Then, the control unit 80 starts temperature control of the belt 42 according to an induction heating method by supplying power to the coil 47*a* of the coil unit 47 (S304). More specifically, the control unit 80 drives an unshown high-frequency drive power source from which a power of 0 to 1 (kW) is appropriately supplied to the coil 47*a* by an AC current of 10-100 (kHz). A magnetic field induced in the belt 42 by the AC current passes eddy current through the Ni electroconductive layer to generate Joule heat. As a result, the belt 42 and the pressure roller 45 are uniformly increased in temperature in a circumferential direction.

Next, the control unit 80 determined whether or not the temperature of the belt 42 detected by the temperature sensor 48 has reached a target temperature (190° C. in this embodiment). When the temperature is less than the target temperature, temperature control of the belt 42 and temperature control of the pressure roller 45 are still performed continuously. When the temperature reaches the target temperature, the operation goes to a next step (S305).

The control unit 80 stops the temperature control of the pressure roller 45 by the heater 46 after the temperature of the belt 42 reaches the target temperature (S306).

In accordance with the above described control flow, the temperature control sequence during startup of the control unit 40 is completed. Thereafter, the temperature control of the fixing unit 40 is effected only by the temperature control of the belt 42 according to the induction heating method.

More specifically, in such a state that the belt 42 is temperature controlled so as to have the target temperature, the transfer material P on which the four-color toner image is carried is guide into the nip N. The transfer material P is nipped and conveyed in the nip N by the belt 42 and the pressure roller 45. During the conveyance, the toner image is fixed on the transfer material surface by heat and pressure.

As described above, in this embodiment, during the startup of the fixing unit 40, the temperature control of the pressure roller 45 by the heater 46 is effected in a state in which the belt 42 and the pressure roller 45 are stopped. For this reason, it is possible to transmit the temperature control temperature of the pressure roller 45 through the nip N. As a result, it is possible to reduce a time from the start of rotational drive of the heater 46 to an increase in temperature of the belt 42 up to the target temperature. Accordingly, it is possible to compatibly realize enhancement of durability of the belt 42 generating heat by the magnetic flux from the coil unit 47 and early rise up of the temperature of the belt 42 up to the target temperature.

Further, in the case of increasing the temperature of the pressure roller 45 up to the target temperature, the heater 46 is used. In the case of effecting temperature control of the pressure roller 45 and the belt 42, both of the heater 46 and the coil unit 47 are used. Further, after the belt 42 is increased in temperature up to the target temperature, the coil unit 47 is used. In this manner, an optimum heating method is selected, so that it is possible to achieve electric power savings.

Embodiment 2

Another embodiment of the fixing unit will be described.

The fixing unit in this embodiment has the same constitution as that used in Embodiment 1 except for the control unit 80. Common members of the fixing unit 40 used in Embodiment 1 are represented by the same reference numerals, thus being omitted from explanation.

As described above, in the control during the startup of the image forming apparatus, together with the temperature control of the fixing unit 40, control of initial operations and image adjustments (process adjustment, registration adjustment, image density adjustment, etc.) of the respective apparatuses is effected. The time required for effecting rise up of temperature of the belt by temperature control according to the induction heating method is shorted than that required for effecting these initial operations and image adjustments. For this reason, the temperature control startup is started so that the temperature control startup of the fixing unit 40 is completed substantially in synchronism with the timings of end of the initial operations and image adjustments. As a result, it is possible to further prolong the life of the belt 42.

In this embodiment, for example, the initial operations and image adjustments are effected in the order of the initial operations, the process adjustment, the registration adjustment, and the image density adjustment. Further, the time required for the image density adjustment is substantially equal to the time required for the startup operation of the fixing unit 40. In other words, the startup operation of the fixing unit 40 is started simultaneously with the start of the image density adjustment.

Figure 5:
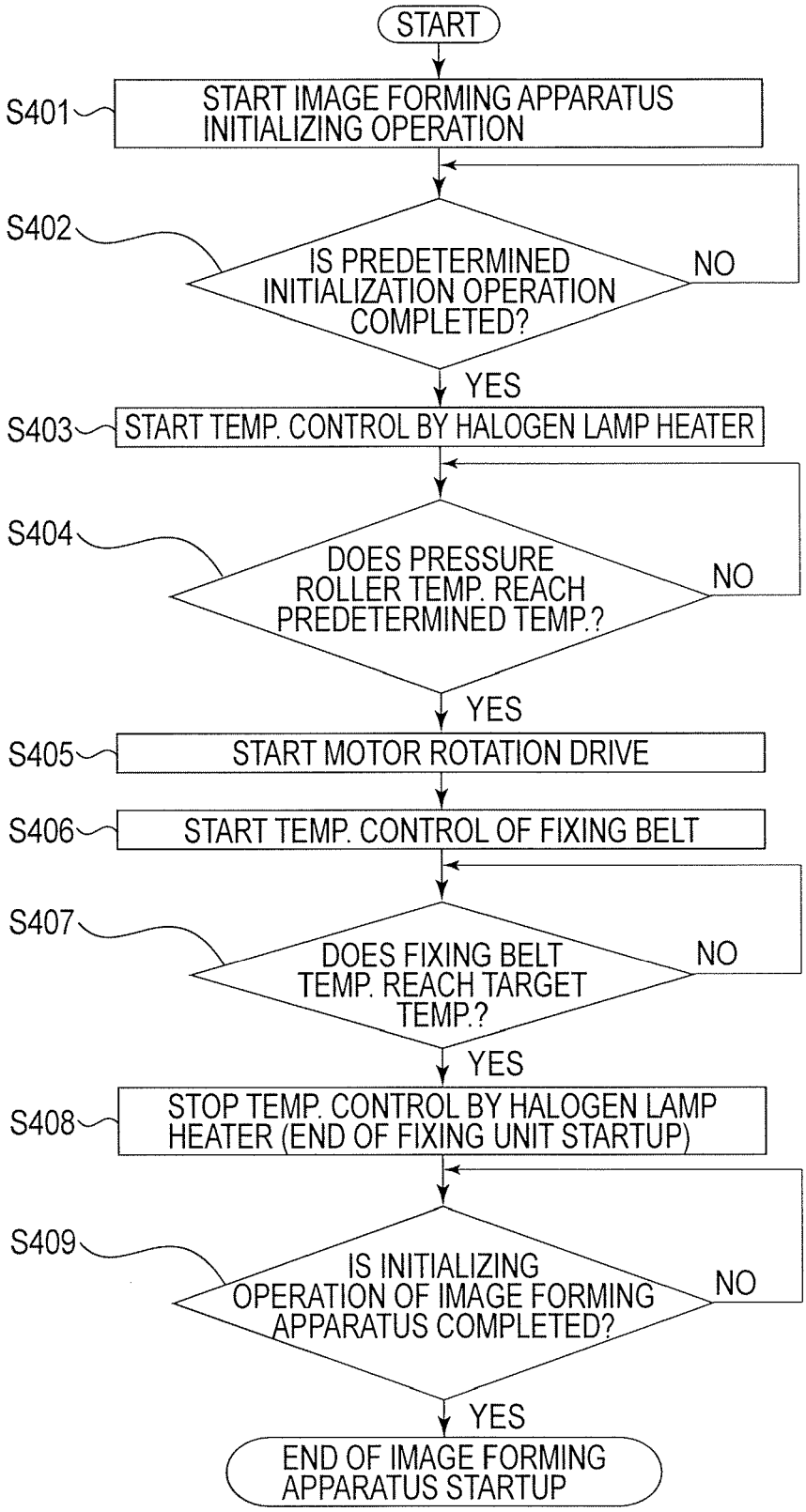
FIG. 5 is a control flow chart showing an example of control procedure during startup of a fixing unit used in Embodiment 2 of the present invention.

FIG. 5 shows a control flow chart of an example of control of the fixing unit 40 in this embodiment during startup.

Referring to FIG. 5, the control unit 80 first effects an initializing operation other than a startup operation of the fixing unit 40 in the image forming apparatus (S401). More specifically, the initial operations, the process adjustment, and the registration adjustment are performed.

Next, the control unit determines whether or not the initializing operation (S401) is completed (S402). When the initializing operation is completed, the control operation goes to a next step.

In Steps S403 to S407, the same processings as those in the steps S301 to S305 in the control flow of Embodiment 1 are effected.

In step S408, the control unit 80 stops the temperature control of the pressure roller 45 effected by the heater 46 after the temperature of the belt 42 reaches the target temperature, thus completing the startup of the fixing unit 40.

Next, the control unit 80 determines whether the entire initializing operation is completed or not (S409). When the initializing operation is completed, the startup operation of the image forming apparatus is completed.

In accordance with the above described control flow, the startup operation of the image forming apparatus including the temperature control sequence during the startup of the fixing unit 40 is completed. Thereafter, the operation of the image forming apparatus including the temperature control of the fixing unit 40 only by the temperature control of the fixing belt 42 according to the induction heating method is continued.

As described above, in this embodiment, the temperature control startup of the fixing unit 40 is started at predetermined timing for control of the image forming apparatus during startup of the image forming apparatus. More specifically, during the startup of the fixing unit 40, the temperature control of the pressure roller 45 by the heater 46 is started in such a state that the belt 42 and the pressure roller 45 are stopped. As a result, this embodiment is capable of achieving the same action and effect as in Embodiment 1.

Further, in the control of the image forming apparatus during the startup, the temperature control startup of the fixing unit 40 is effected at timing such that the initial operations and the image adjustments which require a time longer than that for the startup of the fixing unit 40 is completed to some extent. As a result, it is possible to further extend the life of the belt and achieve electric power savings.

Other Embodiments

1) In the above described embodiments, with respect to the electric power supplied to the coil 47*a*, the power during the startup may also be increased compared with that after the startup. For example, assuming that a power required after the startup is 800 W, a power of 1100 W is supplied during the startup in order to increase temperature early. In this regard, the sum of the power (1100 W) supplied to the coil 47*a*, the power (e.g., 300 W) supplied to the heater 46, and the power (e.g., 100 W) required for other startup operations of the image forming apparatus is needed to be set so as not to exceed a predetermined value (1500 W in this case) of power.

2) In the above described embodiments, rotation speeds (process speeds) of the belt 42 and the pressure roller 45 are not mentioned. However, these rotation speeds during the startup may be slower than those after the startup.

3) In the above described embodiments, as the pressure rotation member, the pressure roller 45 is used. However, similarly as in the fixation side, it is also possible to employ such a constitution that one belt and two rollers are used. In this case, the halogen lamp heater 46 may be disposed on either one side or both sides of the rollers.

4) In the above described embodiments, the halogen lamp heater 46 is disposed inside the pressure roller 45 but may also be disposed outside the pressure roller 45 in contact with the pressure roller 45. Alternatively, the heater 46 may be incorporated into at least one of the drive roller 43 and the follower roller 44 or disposed outside at least one of these rollers in contact with these rollers.

5) In the above described embodiments, the timing of completion of the startup sequence by stopping the rotational drive start of the motor 41, the temperature control start of the belt 42, and the temperature control of the pressure roller 45 effected by the halogen lamp heater 46 is set to such a time that the detection temperature by the temperature sensors 48 and 49 is the target temperature. However, the timing may also be a time after a lapse of predetermined time.

6) In Embodiment 2, with respect to the timing of the temperature control start by the halogen lamp heater 46, the control flow effected at the predetermined timing during the startup control of the image forming apparatus is described. However, the control flow may also be started at the timing of startup control of the image forming apparatus. In this case, the temperature control start timing of the belt 42 according to the induction heating method is substantially identical to that described in Embodiment 2.

7) The image heating apparatus according to the present invention is not limited to the fixing apparatus but may also be effectively applicable to other image heating apparatuses such as a temporary fixing apparatus for temporarily fixing an unfixed image on a material to be recorded, and a surface modifying apparatus for modifying an image surface property such as gloss or the like by reheating a material, to be recorded, on which a fixed image is carried.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 265877/2005 filed Sep. 13, 2005, which is hereby incorporated by reference.

What is claimed is:

1. An image heating apparatus, comprising:

magnetic flux generation means for generating magnetic flux;

an endless belt having an electroconductive layer which generates heat by the magnetic flux from said magnetic flux generation means, said endless belt heating an image on a recording material;

stretching means for stretching said endless belt;

a pressure rotation member contactable with said endless belt under pressure to form a nip therebetween;

heating means for heating said pressure rotation member;

drive means for rotationally driving said endless belt; and control means for effecting control so that power supply to said heating means is started on the basis of an image heating start signal and when a temperature of said pressure rotation member reaches a set temperature, power supply to said magnetic flux generation means is started while starting the rotational drive of said endless belt by said drive means.

2. An apparatus according to claim 1, wherein said pressure rotation member is heated in contact with said endless belt while the temperature of said pressure rotation member reaches the set temperature.

3. An apparatus according to claim 1, wherein said control means effects power supply to both of said heating means and said magnetic flux generation means until a temperature of said endless belt reaches a target temperature since the power supply to said magnetic flux generation means is started and effects power supply only to said magnetic flux generation means after the temperature of said endless belt has reached the target temperature.

4. An apparatus according to claim 1, wherein said heating means is a halogen lamp heater.

5. An image heating apparatus, comprising:

magnetic flux generation means for generating magnetic flux;

an endless belt having an electroconductive layer which generates heat by the magnetic flux from said magnetic flux generation means, said endless belt heating an image on a recording material;

stretching means for stretching said endless belt;

a pressure rotation member contactable with said endless belt under pressure to form a nip therebetween;

heating means for heating said pressure rotation member;

drive means for rotationally driving said endless belt; and control means for effecting control so that power supply to said heating means is started on the basis of an image heating start signal and after a lapse of a set time from timing of the start of power supply to said heating means, the rotational drive of said endless belt by said drive means, and power supply to said magnetic flux generation means are started.

6. An apparatus according to claim 5, wherein said pressure rotation member is heated in contact with said endless belt while the temperature of said pressure rotation member reaches the set temperature.

7. An apparatus according to claim 5, wherein said control means effects power supply to both of said heating means and said magnetic flux generation means until a temperature of said endless belt reaches a target temperature since the power supply to said magnetic flux generation means is started and effects power supply only to said magnetic flux generation means after the temperature of said endless belt has reached the target temperature.

8. An apparatus according to claim 5, wherein said heating means is a halogen lamp heater.

* * * * *